US007805774B2

(12) United States Patent
Müller

(10) Patent No.: US 7,805,774 B2
(45) Date of Patent: Oct. 5, 2010

(54) PANTS, IN PARTICULAR RIDING JEANS

(76) Inventor: Tanja Müller, Lettow-Vorbeck-Strasse 30a, 41063 Mönchengladbach (DE)

( * ) Notice: Subject to any disclaimer, the term of this patent is extended or adjusted under 35 U.S.C. 154(b) by 12 days.

(21) Appl. No.: 11/874,029

(22) Filed: Oct. 17, 2007

(65) Prior Publication Data

US 2008/0092266 A1 Apr. 24, 2008

Related U.S. Application Data

(60) Provisional application No. 60/886,115, filed on Jan. 23, 2007.

(30) Foreign Application Priority Data

Oct. 19, 2006 (DE) ..... 20 2006 016 230 U
Oct. 30, 2006 (DE) ..... 20 2006 016 727 U

(51) Int. Cl.
*A41D 13/00* (2006.01)
*A41D 9/00* (2006.01)

(52) U.S. Cl. ..... 2/227; 2/79; 2/69

(58) Field of Classification Search ..... 2/227, 2/228, 79, 69, 243.1
See application file for complete search history.

(56) References Cited

U.S. PATENT DOCUMENTS 366,155 A * 7/1887 Crisp ..... 2/227
1,416,383 A * 5/1922 Rose ..... 33/12
2,280,017 A * 4/1942 Wilker et al. ..... 2/227
3,959,826 A * 6/1976 Hakanson ..... 2/227

FOREIGN PATENT DOCUMENTS

| | | |
|---|---|---|
| DE | 2 28 477 | 11/1910 |
| DE | 19 32 607 | 2/1966 |
| DE | 70 39 253 | 2/1971 |
| DE | 72 10 798 | 9/1972 |
| DE | 22 27 411 | 1/1973 |
| DE | 78 29 183 | 1/1979 |
| EP | 04 38 979 | 7/1991 |

OTHER PUBLICATIONS

Catalogue: Co. Krämer, fall/winter, 2006/2007, p. 6, article No. 810061 and 810050.

* cited by examiner

*Primary Examiner*—Gloria Hale
(74) *Attorney, Agent, or Firm*—Henry M. Feiereisen; Ursula B. Day

(57) ABSTRACT

A pair of pants includes two pant legs, with each pant leg having a front pant panel and a back pant panel which are interconnected by two side seams. The front and back pant panels are sized such that one of the side seams has a seam course which, at least in one section is shifted to the back toward a leg back side of a wearer.

10 Claims, 4 Drawing Sheets

PANTS, IN PARTICULAR RIDING JEANS

CROSS-REFERENCES TO RELATED APPLICATIONS

This application claims the benefit of prior filed U.S. Provisional Application No. 60/886,115, filed Jan. 23, 2007, pursuant to 35 U.S.C. 119(e).

This application claims the priority of German Patent Applications, Serial Nos. 20 2006 016 230.5, filed Oct. 19, 2006, and 20 2006 016 727.7, filed Oct. 30, 2006, pursuant to 35 U.S.C. 119(a)-(d).

The contents of U.S. Provisional Application No. 60/886, 115, and German Patent Applications, Serial Nos. 20 2006 016 230.5 and 20 2006 016 727.7 are incorporated herein by reference in their entirety as if fully set forth herein.

BACKGROUND OF THE INVENTION

The present invention relates to a pair of riding pants in the form of jeans, in particular for use in Western-style equitation, which can be used for women, men as well as children.

Riding pants, i.e. pants that are suited in particular to the demand in equitation, come in various designs and differ from other pants as far as cut as well as material selection, workmanship, leather trimming etc. are concerned. These modifications are intended to take into account the special demands when the rider comes into contact with the saddle or the horse. In Western-style equitation, jeans are traditionally worn on the horse and basically resemble the typical design of jeans, except for the longer selection of pant legs to compensate when the pants are slightly pulled up during riding.

In conventional jeans, front and back pant panels of each pant leg are interconnected by side seams, whereby the front pant panels have a same width and are normally narrower than the back pant panel, and whereby both side seams as viewed from the construction line in midsection of the front and back pant panels have a same distance on both sides. The inner side seam runs along the leg inner side of the wearer approximately in midsection thereto so that the respective side seams precisely oppose one another, i.e. in 180° spaced-apart relationship. As a result, the inner side seams run along the leg inner sides of the jeans. This causes pressure and chafing areas on the leg inner sides of the rider during riding, when the rider comes into contact with the horse belly. In addition, the seam line of these jeans may cause chafing or wounds above the legs in the sensitive areas of the buttock and crotch when the rider moves relative to the saddle.

To address these problems, riding jeans have been developed that have seams that are shifted to the "outside" in an effort to reduce the chafing effect on the inside body parts. Apart from a poor aesthetic look, the seams, despite being shifted to the "outside", still cause a chafing effect on the inside, rendering these types of riding jeans unsatisfactory. Another approach involves jeans with so-called "seamless" pant legs, in which a single side seam runs outside of the inner leg area. This type of jeans can, however, be cut only "tubular" so that the shape of the leg, knee, or thigh cannot be taken into account and thus the fit of such jeans is unsatisfactory in the leg area, causing again chafing areas as a result of crease formation and being aesthetically inadequate.

It would therefore be desirable and advantageous to provide an improved pair of pants to obviate prior art shortcomings.

SUMMARY OF THE INVENTION

According to one aspect of the present invention, a pair of pants includes two pant legs, with each pant leg having a front pant panel and a back pant panel which are interconnected by two side seams, wherein the front and back pant panels are sized such that one of the side seams has a seam course which, at least in one section, is shifted to the back toward a leg back side of a wearer.

The present invention resolves prior art problems by shifting the inner side seam of each pant leg, or at least a section thereof along the pant leg, further to the back side of the legs. As a result, the shifted side seam is removed from the region at which the leg of the rider typically comes into contact with the horse belly or the saddle flaps or fenders, thereby positively preventing the presence of pressure and chafing areas, while still providing a reliable seat of the pant legs without interference during riding and without significantly altering the overall look of a jeans design.

The other outer side seam of each pant leg may run along the leg outer side, as common in conventional jeans designs. Thus, the two side seams of each pant leg are no longer spaced in opposing 180° spaced-apart relationship along the pant leg circumference.

According to another feature of the present invention, the one side seam may extend upwards from a heel area of the wearer and converges at a meeting point in an upper region of the pair of pants in a central buttock seam. Suitably, the meeting point is situated at a height sufficient to prevent the wearer to sit on the meeting point.

According to another feature of the present invention, the pant leg may have a length of varying diameter.

A pair of pants in accordance with the invention can be designed in a wide range of configurations beyond a tubular design, e.g. the jeans may have a slight tapering in the knee region. The present invention deviates from conventional designs in that the front pant panel is wider than the back pant panel and the distances of the inner and outer side seams from the construction line in midsection of the front pant panel and the back pant panel are no longer the same in the respective pant leg.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
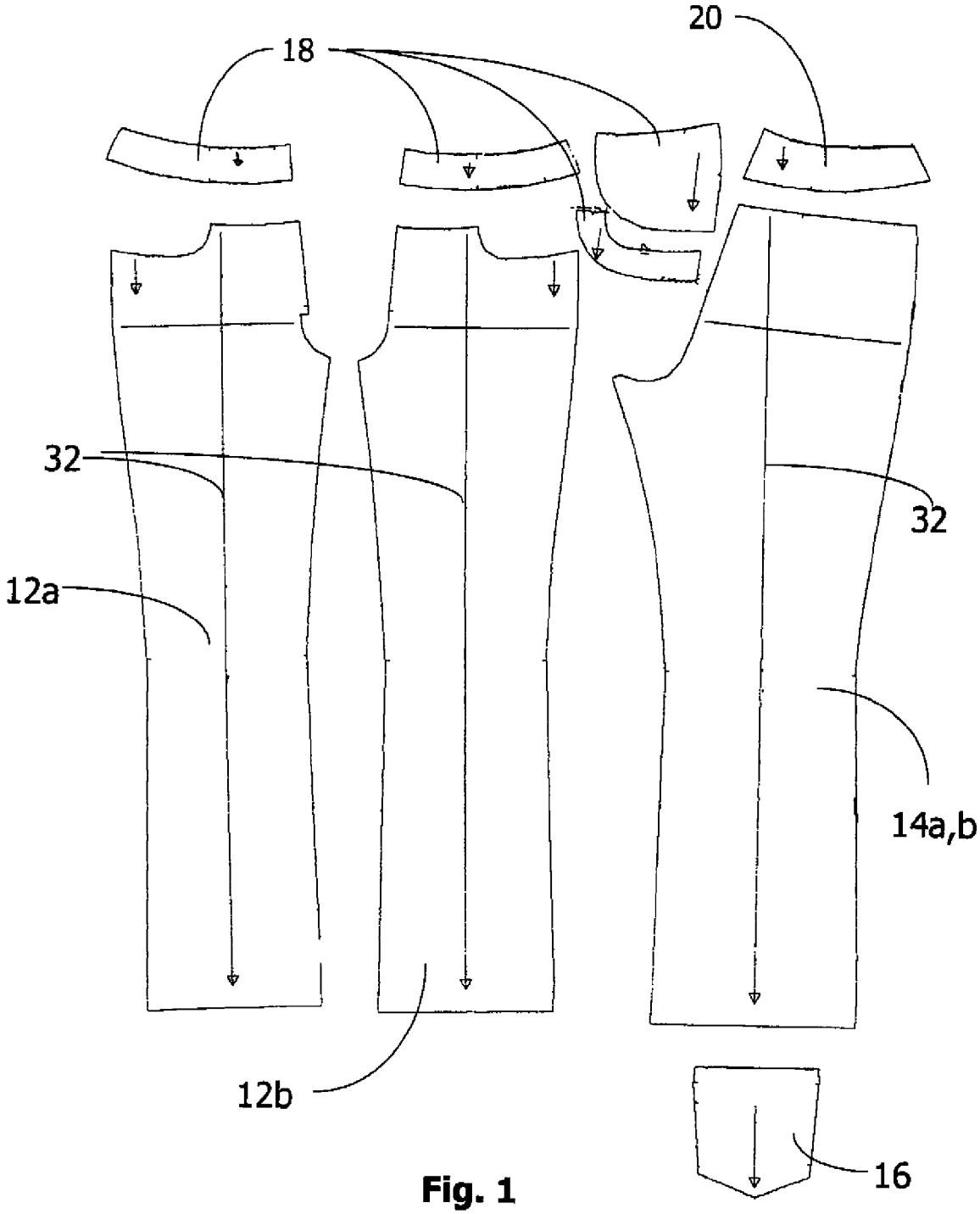
Fig. 1 (Prior Art)
FIG. 1 is a plan view of individual material panels, laid flat, for a prior art pair of jeans.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a plan view of individual material panels, laid flat, for a conventional pair of jeans which is also usable as riding jeans. The pair of jeans has two pant legs 8*a*, 8*b*, each pant leg 8*a*, 8*b* including two parts, i.e. a front pant panel 12*a*, 12*b* and a back pant panel 14*a*, 14*b*. FIG. 1 shows only one back pant panel 14*a*, 14*b*, even though a second back pant panel is required, because the two back pant panels are mirror images of one another. The front pant panels 12*a*, 12*b*, on the other hand, slightly differ from one another because of the different configuration in the area of the zipper of the pants and thus have been shown separately in FIG. 1 (this is not the case in FIG. 2 described furtherbelow). Arrow 32 designates a construction line to indicate the middle or run of thread of the respective pant leg and corresponds to the position of the middle of the leg of the wearer of the pair of pants.

In addition to the back and rear pant panels, the pair of jeans includes further components such as saddle piece 20 (for the buttock), pockets 16 as well as further components 18 for the waistband. As these components do not form part of the invention, further description thereof is omitted for the sake of simplicity. The individual components are sewn together in a known manner for producing the jeans so that seams are formed at the respective interfaces. These technically required seams for joining two material components are to be distinguished from mere decorative seams.

As shown in FIG. 11 the front pant panel 12*a*, 12*b* and the back pant panel 14*a*, 14*b* are of substantially same width at least in the bottom area of the pant legs so that the construction line 32 of the front and back pant panels has approximately a same distance from the hemline to about midsection of the wearer's thigh in relation to the side seams. As a result, the joining side seams extend along the circumference of the pant legs typically at an angular distance of about 180°, i.e. in opposing relationship, and at the leg inner and outer sides, respectively, of a wearer of the pants.

Figure 2:
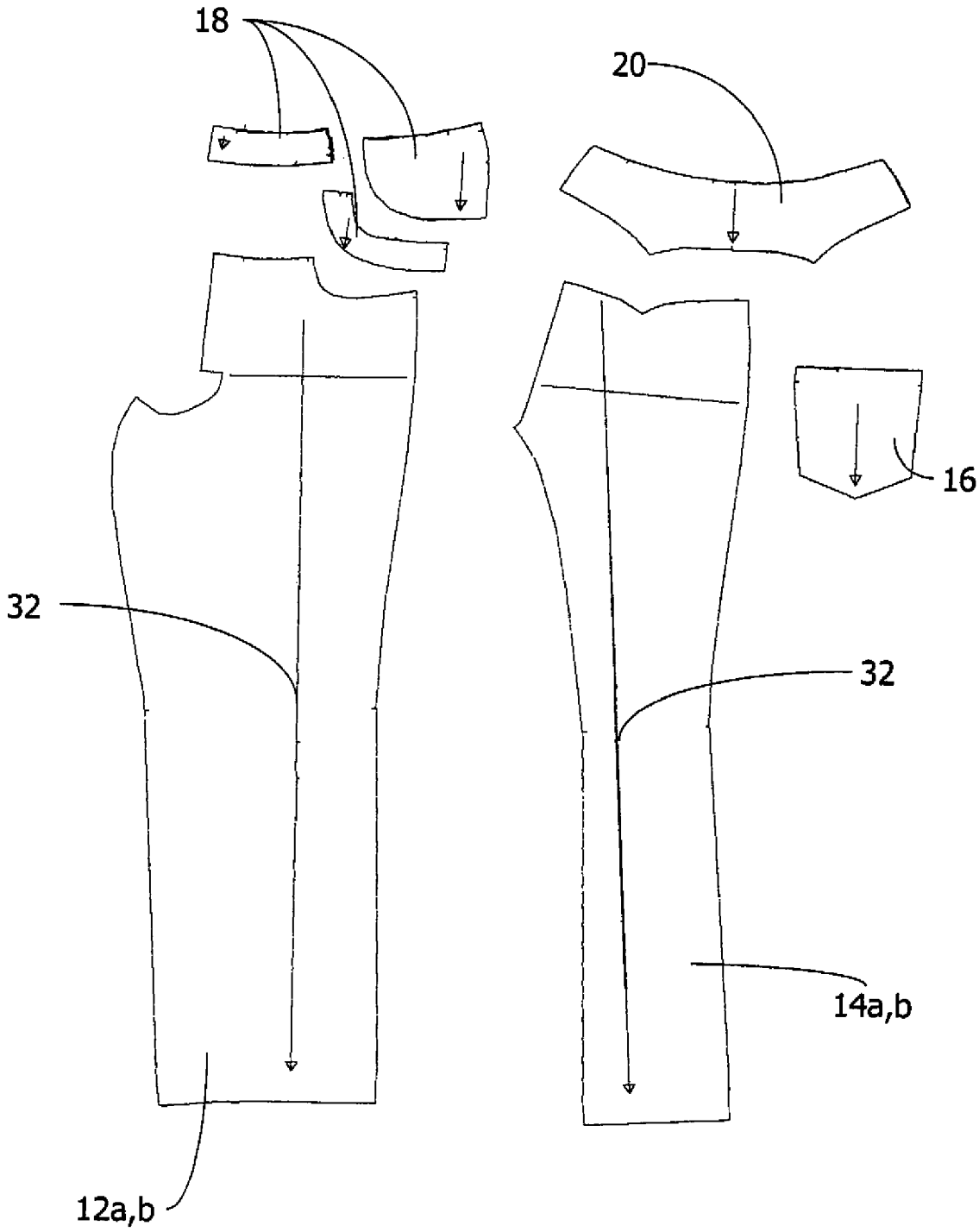
FIG. 2 is a plan view of individual material panels, laid flat, for a pair of (riding) jeans according to the present invention.

Turning now to FIG. 2, there is shown a plan view of individual material panels, laid flat, for a pair of (riding) jeans according to the present invention. Parts corresponding with those in FIG. 1 are denoted by identical reference numerals for ease of understanding the differences. In the jeans of FIG. 2, the front pant panel 12*a*, 12*b* is cut to include part of the back pant panel 14*a*,14 *b* so that the inner side seam is shifted to the leg back side, while the position of the outer seam of each pant leg essentially remains unchanged. In other words, the outer and inner side seams no longer oppose one another, and the construction lines 32 have no longer a same distance to the two side seams. The back pant panel 14*a*, 14*b* becomes narrower, while the front pant panel 12*a*, 12*b* becomes wider so that the construction line 32 of the back pant panel 14*a*, 14*b* is at a substantially smaller distance to the inner side seam than the construction line 32 of the front pant panel 12*a*, 12*b*.

The shift of the inner side seams is implemented just about far enough so that the shifted side seam is no longer perceptible when the leg of a rider contacts the horse belly or saddle flaps or fenders, but also does not interfere with the shape of the pant leg and the fit of the pair of pants. The shift of the inner side seams to the back may amount to about 25% to 40% of the knee size of the back pant panel 14*a*, 14*b*. Currently preferred is a shift of about 30% of the knee size of the back pant panel 14*a*, 14*b*, whereby, compared to the knee or hem region, this percentage may slightly deviate in the thigh area in view of the greater leg circumference.

As a result, the cut of the pant legs can confer a fit beyond a tubular design, e.g. the jeans may have a slight tapering in the knee region, as shown in FIG. 2. For example, when the knee width of the back pant panel 14*a*, 14*b* is 24 cm, the shift of the inner side seam may amount to between 6 and 9.6 cm. The front pant panel 12*a*, 12*b* is wider than the back pant panel 14*a*, 14*b*, and the distances of the side seams from the construction line 32 are no longer the same in the respective leg.

Figure 3:
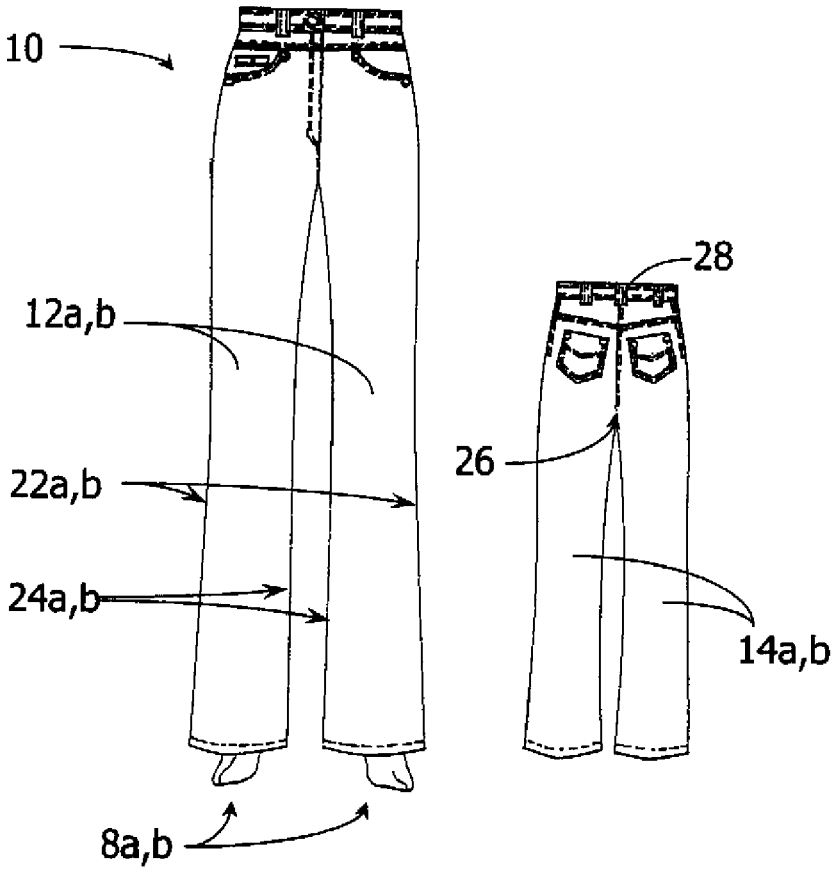
Fig. 3 (Prior Art)
FIG. 3 is an isometric view of the front and back panels of the prior art jeans.
Figure 4:
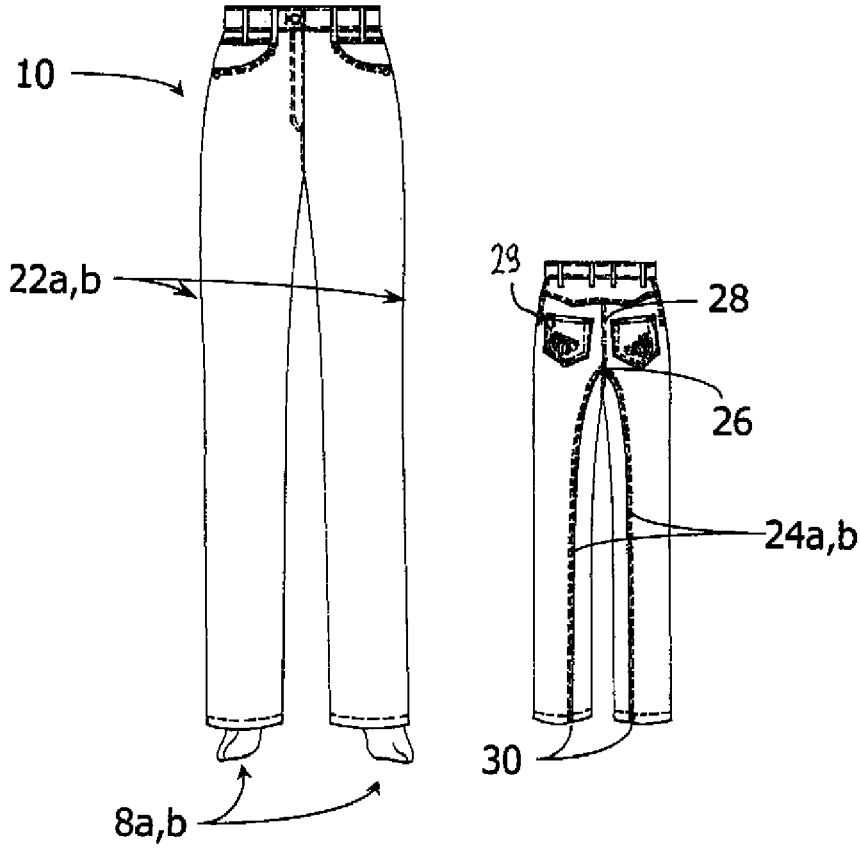
FIG. 4 is an isometric view of the front and back panels of the riding jeans according to the present invention, without back pockets.

The pair of jeans according to the present invention is schematically illustrated in FIG. 4, with the front shown on the left-hand side, and the back shown on the right-hand side on a smaller scale. For ease of understanding and comparison, FIG. 3 shows again a conventional pair of jeans. Reference signs 22*a, b* designate outer seams, and reference signs 24*a*, 24*b* designate the inner seams which are not visible in FIG. 3 in view of their position.

Compared to FIG. 3, the right-hand side illustration in FIG. 4 shows the different position of the inner side seams 24*a*, 24*b* by way of the rear view of the pair of pants 10. The inner side seams 24*a*, 24*b* initially extend upwards from about the heel 30 of a person wearing the pants (or slightly offset inwards in relation to the heel) in approximate parallel relationship to then meet a buttock seam 28 in an intersection or meeting point 26 in the buttock area. The meeting point 26 is thus situated at a location shifted in the back from a vertical center plane of the wearer's body in a direction of the waistband of the pants. Again compared to FIG. 3, the meeting point 26 of the pants 10 according to the present invention lies higher than in conventional jeans, thereby preventing pressure and chafing areas in the buttock region and/or crotch region because the meeting point 26 no longer lies in the seating zone. Like the shift of the inner side seams, the meeting point 26 is also shifted upwards just about far enough to realize the described effect and to prevent interference with the fit of the jeans.

Figure 5:
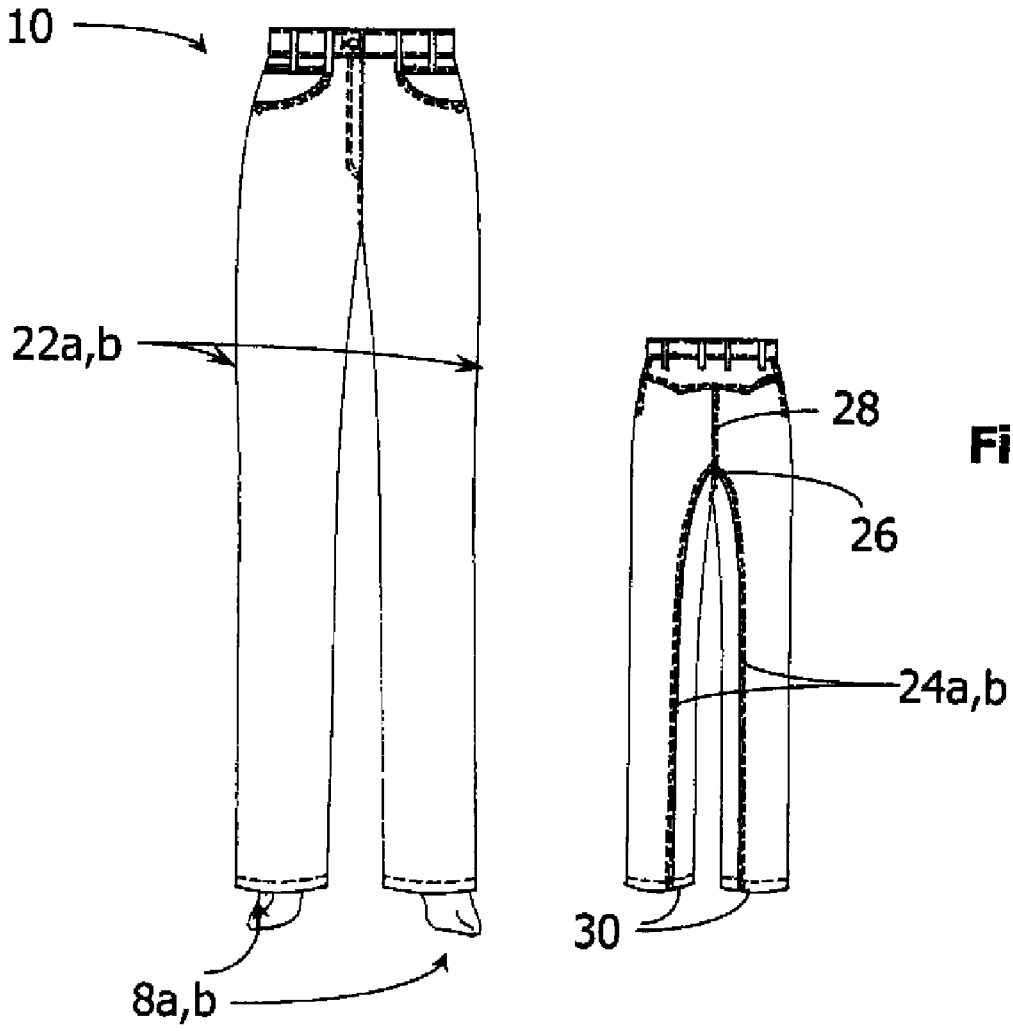
FIG. 5 is an isometric view of the front and back panels of the riding jeans according to the present invention, with back pockets.

FIG. 5 shows a pair of pants which differs from the embodiment of FIG. 4 solely by the provision of additional back pockets 29.

The riding pants according to the invention may have any design and can be optically modified by pockets, flaps, decorative stitching, embroideries, and other ornamentations. The pants can be made from jeans material, cotton, or leather and designed stable, transversely elastic, longitudinally elastic, or bi-elastic. Furthermore, the principle according to the invention may be realized regardless whether men's pants, women's pants, or children's pants are involved.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A pair of pants, comprising two pant legs, each said pant leg including a front pant panel and a back pant panel which are interconnected by two side seams and define a waistband, said front and back pant panels being sized such that an inner one of the side seams has a seam course which, at least in one section, is shifted to the back toward a leg back side of a wearer, wherein the inner side seam extends upwards from a heel area of the wearer and converges in an upper region of the pair of pants in a central buttock seam at a meeting point which is situated at a location shifted in the back from a vertical center plane of the wearer's body in a direction of the waistband of the pants so as to prevent the wearer to sit on the meeting point when assuming a seated position.

2. The pair of pants of claim 1, wherein the two side seams are the only side seams.

3. The pair of pants of claim 1, wherein the pant leg has a length of varying diameter.

4. The pair of pants of claim 1, wherein the pant leg is made of jeans material, cotton, or leather.

5. The pair of pants of claim 1, wherein the front pant panel has a width which is wider than a width of the back pant panel.

6. The pair of pants of claim 1, wherein the back pant panel is defined by a pant leg circumference in an area of the wearer's knee, said inner side seam being shifted to the back by about 25% to 40% of the pant leg circumference of the back pant panel.

7. The pair of pants of claim 1, wherein the back pant panel is defined by a pant leg circumference in an area of the wearer's knee, said inner side seam being shifted to the back by about 30% of the pant leg circumference of the back pant panel.

8. The pair of pant of claim 1 for use as a pair of riding pants in the form of jeans.

9. The pair of pants of claim 1, wherein the inner side seam is shifted to the back sufficient to prevent a rubbing of the inner side seam upon a leg inner side of the wearer when assuming the seated position during riding a horse and when the leg inner side contacts the horse belly.

10. The pair of pants of claim 1, wherein the other one of the side seams extends substantially along a leg outer side of the wearer.

* * * * *